US006021824A

United States Patent [19]

Larsen et al.

[11] Patent Number: 6,021,824

[45] Date of Patent: Feb. 8, 2000

[54] KIT FOR STORAGE AND MIXING OF AGENTS OF WHICH AT LEAST ONE IS LIQUID

[75] Inventors: Andre Larsen, Dragør; Gabriel Jørgensen, Copenhagen; Peter Norland Jensen, Kastrup; James M. Flink, Frederiksberg; Peter Christian Klitgaard, Smørum, all of Denmark

[73] Assignee: Novo Nordisk A/S, Bagsvaerd, Denmark

[21] Appl. No.: 08/894,641

[22] PCT Filed: Feb. 29, 1996

[86] PCT No.: PCT/DK96/00085

§ 371 Date: Aug. 26, 1997

§ 102(e) Date: Aug. 26, 1997

[87] PCT Pub. No.: WO96/26702

PCT Pub. Date: Sep. 6, 1996

[30] Foreign Application Priority Data

Mar. 2, 1995 [DK] Denmark ..... 0218/95

[51] Int. Cl.[7] ..... B65B 1/04

[52] U.S. Cl. ..... 141/329; 141/59

[58] Field of Search ..... 141/329, 330, 141/371, 59, 198, 323, 325, 326, 7, 11, 100

[56] References Cited

U.S. PATENT DOCUMENTS 3,872,867 3/1975 Killinger ..... 141/329

3,938,520 2/1976 Scislowicz et al. ..... 141/330

FOREIGN PATENT DOCUMENTS 0 123 659 10/1984 European Pat. Off. .

0 197 383 10/1986 European Pat. Off. .

1337376 8/1963 France .

2487680 2/1982 France .

*Primary Examiner*—David J. Walczak

*Attorney, Agent, or Firm*—Steve T. Zelson, Esq.

[57] ABSTRACT

A kit for mixing comprises a housing accommodating an ampoule containing a solid and a container containing a solvent which is either pre-pressurized or which may be pressurized when it is desired to mix to the liquid and solid components. A needle unit comprises a first needle, the opposite ends of which pierce rubber membranes closing the ampoule and the container, to establish a transport channel through which pressurized solvent flows from the container to the ampoule. The ampoule is vented through a second needle inserted through the membrane of the ampoule and provided with a micro-filter. In one embodiment, the needle unit is displaceable to cause the ends of the needles to pierce the respective membranes, and locked in place by a spring biased locking mechanism. A branch passage from the needle is connected to a cylinder containing a piston coupled to the locking mechanism. When the ampoule is full, pressure in the branch passage will rise, actuating the piston and releasing the locking mechanism. In an alternative embodiment, the needle mechanism is stationary, and the ampoule and container are moved into engagement with the respective needle ends.

11 Claims, 2 Drawing Sheets

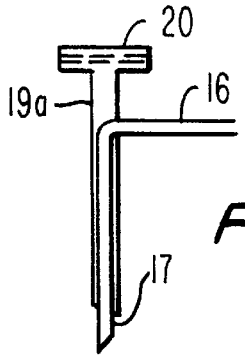
FIG. 2
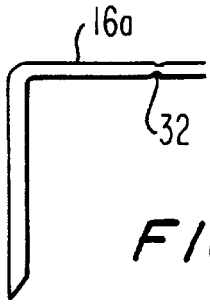
FIG. 3
FIG. 4
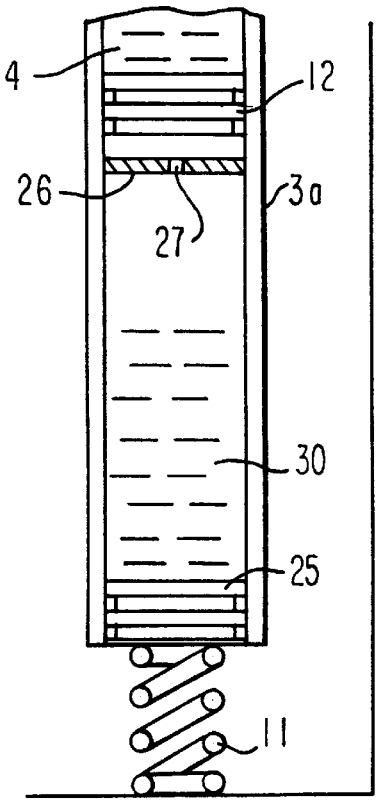
FIG. 5
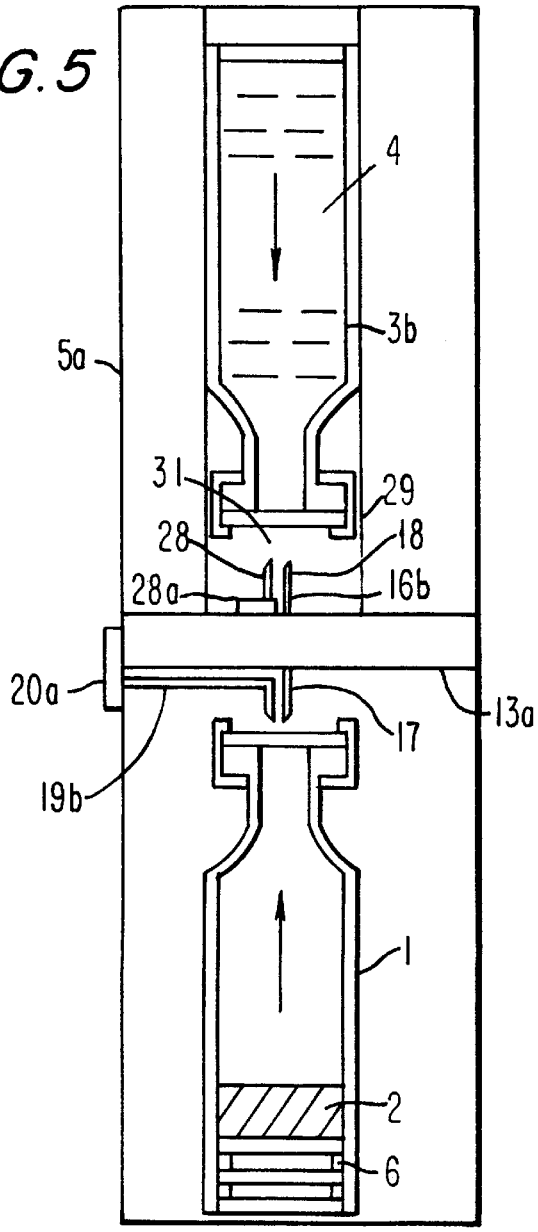

KIT FOR STORAGE AND MIXING OF AGENTS OF WHICH AT LEAST ONE IS LIQUID

CROSS-REFERENCE TO RELATED APPLICATIONS

This application is a 35 U.S.C. 371 national application of PCT/DK96/00085 filed Feb. 29, 1996 and claims priority under 35 U.S.C. 119 of Danish application 0218/95 filed Mar. 2, 1995, the contents of which are fully incorporated herein by reference.

BACKGROUND OF THE INVENTION

The invention relates to storage and mixing of agents of which at least one is a liquid.

Many compositions which have a very short shelf life may be formed by mixing a pair of components which each has a long shelf life. The components may have the form of a powder and a liquid, respectively, and the mixing may be obtained by dissolving the powder in the liquid, but also the mixing of two liquids may lead to the provision of the wanted composition.

The wanted composition may be a solution or a suspension of a medicament in a liquid where the composition resulting from the mixing is usable for injection. E.g. solutions containing certain proteins have shown to be very sensitive and it is therefore preferred to store the dried protein isolated in a vial and to mix it with a solvent, which is similarly isolated stored, a short time before the use of the composition. It shall be noticed that a composition also may be obtained by mixing two liquids which are each stored in its own container as they react with each other in a way which results in a short shelf life for the composition.

When the composition is a medicine for injection, the containers with the isolated agents are commonly sold in a kit comprising a vial containing one agent, e. g. a protein, and a syringe or a cylinder ampoule containing the liquid agent, e. g. the solvent for said protein. When the composition is going to be used, a needle mounted on the syringe or the cylinder ampoule is passed with its pointed end through the closing rubber membrane of the vial, and the piston of the syringe or ampoule is pressed forward to press the solvent through the needle into the vial to dissolve the agent in this vial. When the agent is dissolved and a liquid composition is provided, the piston is drawn back to suck up the solution into the syringe or the ampoule. The syringe may now be used for the injection or the ampoule may be mounted in a syringe allowing the liquid composition in the ampoule to be divided into several set doses, which may be injected at time intervals.

Even during the mixing the composition may show high sensitivity and the mixing should take place without shaking the device and even adding of the solvent as a jet should be avoided. To obtain a gentle mixing the kit may comprise a plastic adaptor which may be mounted on the vial and which has means to guide the needle to an oblique position so that the solvent hits the side wall of the vial rather than the freeze dried protein itself.

Being dependant on the users skill and temper the mixing process is not a well defined process. If the users tactile motor function is reduced it may be a time consuming process to mount the adaptor on the vial, pierce the membrane of this vial, inject the solvent in the vial, wait for the freeze dried product to be solved, and sucking the solution back into the syringe, indeed it may be time consuming even for a skilled person with a good tactile motor function. Further it depends on the users temper how quickly the solvent is injected in the vial. It is recommended to perform this injection sufficiently slowly so that the solvent leaves the needle tip as drops rather than as a jet, as a jet may have a whipping effect on the composition already formed and will increase the formation of foam which is undesirable due to the fact that the foam has a high content of the solved agent which is then made unavailable. The formation of foam further causes a higher risk for air bubbles in the solution sucked back into the syringe or the cylinder ampoule and such air bubbles may have a deteriorating effect on the composition.

Another disadvantage by this known mixing kit is that the piston has to be moved first forward to inject the solvent in the vial and then backward to suck the mixture back into the ampoule. By the forward movement of the piston a part of the inner wall of the cylinder ampoule is exposed to the ambient atmosphere and contaminating material may stick to this wall which is later on brought into contact with the mixture which is sucked into the ampoule by pulling the piston backward.

BRIEF SUMMARY OF THE INVENTION

It is the object of the invention to provide a kit for storage and mixing of agents by which kit the above mentioned drawbacks are avoided.

This object is fulfilled by a kit for storage and mixing of components whereof at least one is liquid, which kit according to the invention is characterized in that it comprises a housing accommodating a container which contains a solvent and is closed by a pierceable membrane, means for pressurizing the solvent in the container, a cylinder ampoule having a first end closed by a pierceable membrane, and a needle unit with needles which by an actuating movement of the needle unit in relation to the housing may be forced to pierce the respective membranes, the needles comprising a first needle with a first and a second pointed end for piercing the ampoule closure membrane and the container closure membrane, respectively, and a second needle having a pointed first end piercing the ampoule membrane by the actuation movement and a second end opening to the atmosphere and being closed by a semipermeable membrane.

With this kit the housing may act as a storage package, and when an ampoule with the mixture is going to be used, an actuator part of the kit is pressed to make the needles penetrate the membranes. Thereafter the mixing takes place automatically as the solvent which is set under pressure will flow through the first needle from the container to the ampoule which is vented through the second needle. Foam formed during the mixing will rise through the ampoule and the air in the foam bubbles will escape through the venting second needle and through the semipermeable membrane which lets only air and not liquid pass. After approximately 30 seconds the ampoule is filled with liquid and as liquid cannot pass the semipermeable membrane, the supply of solvent to the ampoule stops and the mixing is finished. When the mixing is finished the ampoule may be removed from the kit and used in a syringe. As the only thing the user has to do is to press the actuator part and to remove the ampoule when the mixing is done, the user may consider the kit as an equivalent to a package with an ampoule with a ready mixed product. The user will not have to handle adaptors and needles and the mixing is defined by the pressure in the container and the dimensions of the first needle and is not influenced by the user. Further only a minor amount of the active component is lost through the foam so that the overall loss of active component is reduced to about 6–8% instead of the loss of about 16% which is known from the conventional vial/syringe mixing procedure.

According to an embodiment of the kit according to the invention the means for pressurizing the solvent in the container may be a spring biased piston forming the bottom of the container.

The means for pressurizing the solvent in the container may be designed to provide the pressurizing by the actuating movement. Thereby the solvent may be stored in non-pressurized condition.

The container may be provided with a spring which is tightened when the kit is manufactured and which remains tightened during the storage of the container, or the spring may be tightened by the actuating movement as a first step of a mixing-sequence.

The first pointed end of the first needle and the second needle may be coaxial so that the second needle which has a larger diameter than the first needle surrounds the first end of the first needle.

The first needle may be provided with a throttling ensuring that the flow of the solvent from the container to the ampoule lasts for a preset time.

In an embodiment of the kit according to the invention the pressuring means may be damped so that the solvent takes a preset time to flow from the container to the ampoule.

Such a damping may be obtained e.g. by transmitting the pressurizing force of the spring to the piston forming the bottom of the container through a hydraulic transmission containing as viscous fluid the flow of which may more precisely be throttled than the flow of the solvent through the first needle.

The container and the ampoule may be positioned coaxially in the housing with their closing membranes facing each other and the first needle lying between these closing membranes with its pointed first and second end facing the respective membranes. By this embodiment the actuation is obtained by pressing the ampoule and the container towards each other.

Further in this embodiment a third needle may be mounted in the needle unit this third needle having a first pointed end piercing the membrane of the container by the actuation movement and a second end opening outside the container and being closed by a semipermeable membrane, and the container and the needle unit may fit sealingly against the inner wall of the housing. With this design a super atmospheric pressure is provided between the needle unit and the container when this container and the ampoule are pressed towards each other. By this super atmospheric pressure air will pass through the third needle into the container to pressurize the solvent in this container. The length of the second pointed end of the needle must be adapted to the intended position of the container relative to the ampoule. If the ampoule is held lower than the container this second pointed end shall just be long enough to pierce the membrane whereas it should reach to the bottom of the container if this container is placed beneath the ampoule during the mixing unless the container is provided with a riser pipe bringing the solvent to the top of the container when pressurised.

If the kit has to be positioned in a special way, e.g. standing on its bottom side with the container placed above the ampoule, position sensors may be provided which only allows the actuation movement to be performed when the kit is placed in the right position.

The provision of at least one spring, which is tightened by the actuation movement so that this spring will draw out simultaneously the pointed needle ends from their membrane piercing positions when the mixing is finished, will ensure that no solvent will spill when the ampoule is removed.

In an embodiment of the kit according to the invention the first needle may be provided with a branch tube connecting the opening of the needle to a space behind a piston in a cylinder. When the container contains more liquid than necessary to fill the ampoule liquid will flow into said cylinder and force the piston outwards when the ampoule is full, as the liquid cannot pass through the semipermeable membrane at the outer end of the ampoule venting needle. When the ampoule is full so that no more liquid flows from the container to the ampoule the pressure in the needle at the position of the branch tube will rise and liquid may be pressed into the cylinder and move the piston outwards. Via a piston rod the outwards movement of the piston may be taken advantage of for performing appropriate operations. E.g. the needles which are inserted through the closing membranes of the container and the ampoule against a spring force may be locked in this inserted position until the locking is released by the influence of said piston rod. Thereby the needles will be retracted from the container and the ampoule and the movement of the piston rod may further release a dispensing device which opens to dispense the ampoule which now is filled with a protein solution and ready for mounting into a pen syringe.

In an alternative embodiment of the kit according to the invention an injection needle may be provided. This needle may communicate with the ampoule, and to ensure that this communication is not established until the mixing has been performed, a three-way-valve may be provided connecting the first needle and the first ampoule membrane penetrating end of this needle and the injection needle so that the first end of said first needle may alternatively communicate with the rest of this first needle and consequently with the container or with the injection needle. Switching of the valve may be performed by the movement of the above mentioned piston rod when the mixing is finished.

When the valve is switched so that the ampoule communicates with the injection needle, this injection needle may be inserted in a person and the content of the ampoule may be injected either by pressing a piston at the rear end of the ampoule into this ampoule or by releasing a tightened spring which may press the piston into the ampoule.

BRIEF DESCRIPTION OF THE DRAWING

FIG. 2. shows a modification of the kit shown in FIG. 1;

FIG. 3 shows a second modification of the kit shown in FIG. 1;

FIG. 4 shows a third modification of the kit shown in FIG. 1; and

FIG. 5 shows schematically a second embodiment of the invention.

DETAILED DESCRIPTION OF THE INVENTION

Figure 1:
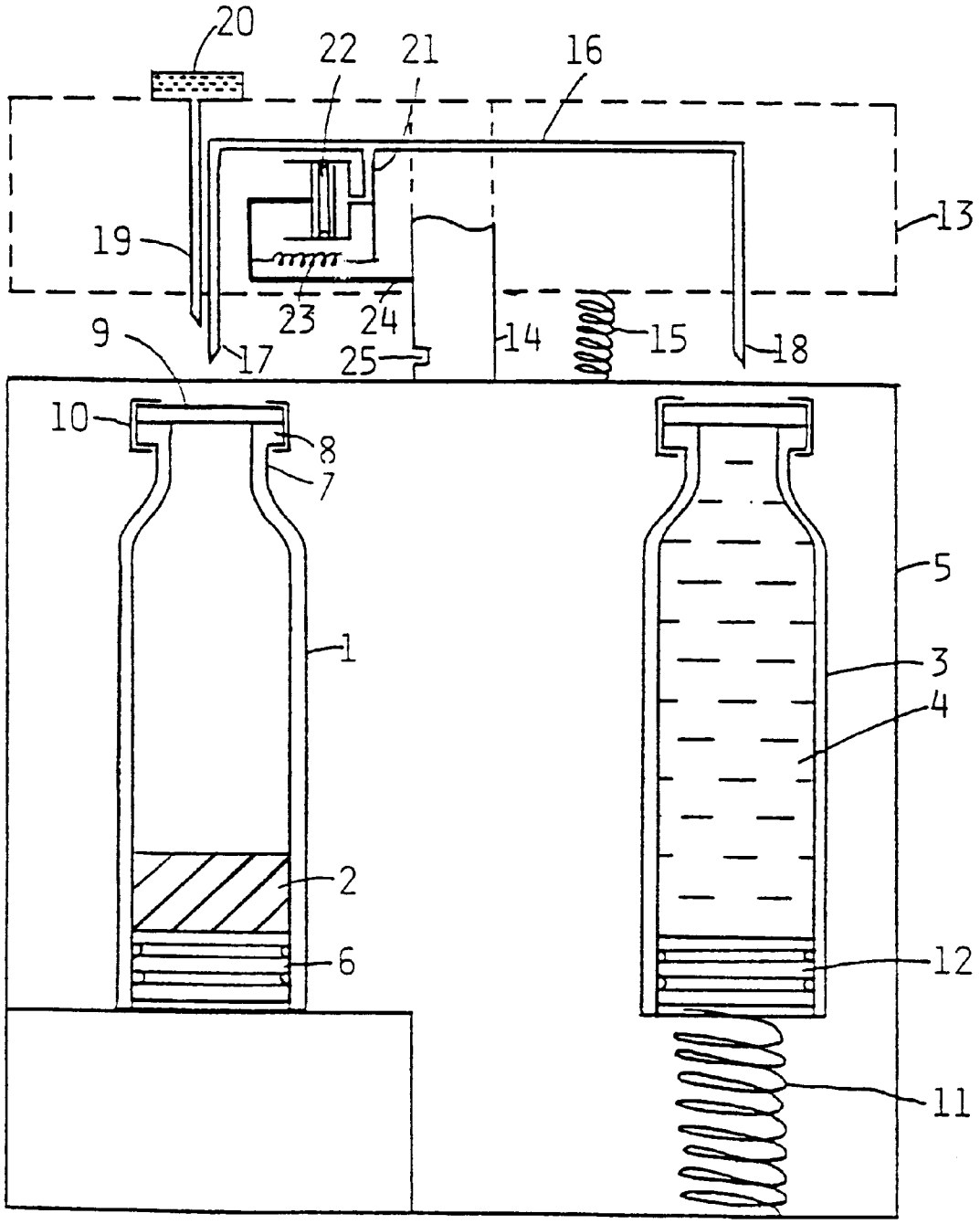
FIG. 1 schematically shows a first embodiment of a mixing kit according to the invention.

An ampoule 1 with a content of a solid product 2 and a container 3 with a solvent 4 is accommodated in a housing 5. The ampoule 1 is of the kind which is at one end closed by a piston 6 an at the other has a neck 7 which is terminated in a flange 8 against which a rubber membrane 9 is held sealingly by a metal cap 10 which is beaded to grip behind the flange 8.

In the shown embodiment the container 3 is shaped like the ampoule 1 and is at one end closed by a piston 12 and at the other end by a rubber membrane sealing against a flange terminating a neck. The solvent 4 is pressurized by a spring 11 which attempts to press the piston 12 into the container.

The container may be shaped in other ways, e.g. as a small bottle with a bottom forming an integral part of the bottle. Also pressurizing may be obtained in other ways, e.g. by a pressurized gas, and precautions may be taken so that the solvent is not pressurized until the pressure shall be used for driving the solvent out of the container.

A needle unit 13 is mounted on a guiding rail 14 projecting from the housing 5 which rail allow movement of the needle unit 13 towards the housing 5. A spring 15 keeps the needle unit at distance from the housing. The needle unit 13 comprises a first needle 16 having a first and a second pointed end 17 and 18, respectively, and the needle is so positioned in the needle unit that its first and second ends will perforate the rubber membranes closing the ampoule 1 and the container 3, respectively, when the needle unit is moved towards the housing along the guiding rail 14. The needle unit further comprises a second needle 19 which has a pointed end, which is so positioned that it will pierce the rubber membrane of the ampoule 1 when the needle unit is moved towards the housing 5 along the guiding rail 14, and another end terminated by a micro filter 20 which allows air but not bacteria to pass.

When the needle unit 13 is moved towards the housing 5 the pointed ends 17 and 18 of the first needle will pierce the membranes of the ampoule 1 and the container 3, respectively. It is appropriate to make the first pointed end 17 a little longer than the second pointed end 18 so as to ensure that the first pointed end 17 communicates with the interior of the ampoule before the second pointed end 18 is connected to the pressurized solvent 4 in the container 3. After that communication between the ampoule 1 and the container 3 is established through the first needle 16, the second needle may pierce the membrane of the ampoule 1 to establish a vent for this ampoule.

The pressurized solvent in the container 3 will now be transmitted through the needle 16 to the ampoule 1 where it will solve the dried product 2. As the ampoule 1 is filled with liquid the air in this ampoule will escape through the vent formed by the needle 19 and the micro filter 20. The micro filter is so fine that contaminating bacteria cannot enter the ampoule through the filter. Further liquid cannot escape through the micro filter and consequently only the air but not the liquid part of foam formed during the solving of the product can escape through the micro filter.

To avoid or to reduce the formation of foam when the solvent is led to the product in the ampoule 1 it is appropriate to control the flow of solvent through the needle 16. This may be done by a throttling obtained by using a very thin needle or by a partial compression of the walls of the needle. Another method is to control the pressurizing, e.g. by inserting a hydraulic system between the spring 11 and the piston 12 of the container. In the hydraulic system a medium may be used which is more viscous than the solvent and the flow of which may consequently be more easily controlled.

The needle 16 is provided with a branch tube 21 opening at the bottom of a small cylinder behind a piston 22. As long as the solvent flows through the needle 16 the pressure in said needle is low, but when the ampoule is full and no liquid can pass out through the vent the flow through the needle 16 will stop and the pressure will rise to the level of the pressure in the container 3. This pressure will work on the inner side of the piston 22 and try to force this piston out of the cylinder. In the schematically shown embodiment of the mixing kit advantage is taken of this fact. A construction ending in a locking pin 24 is mounted to the piston 22. A draw spring 23 is forcing the locking pin against the guiding rail 14 and the piston 22 into the cylinder. When the needle unit 13 against the force of the compression spring 15 is pressed towards the housing 5 to make the pointed ends of the needles pierce the rubber membranes of the ampoule 1 and the container 3, the locking pin 24 will slide along the rail 14 until it reaches a recess 25. The spring 23 will make the locking pin 24 engage this recess and the needle unit 13 is locked in its position with its needles piercing the membranes of the ampoule and the container. The pressurized solvent will flow from the container 3 into the ampoule 1 and the air in this ampoule will escape through the needle 19 and the filter 20. When the ampoule is full and all the air in this ampoule has escaped through the filter 20, the solution in the ampoule will rise through the needle 19 but will be stopped by the filter 20. Then the flow through the needle 16 will stop and the pressure behind the piston 22 will rise and press this piston outwards in the cylinder against the force of the spring 23. Then the pin 24 will be drawn out of engagement with the recess 25 and the needle unit will be released and will by the spring 15 be pressed away from the housing. Thereby the pointed needle ends will be drawn out of the rubber membranes and the now filled ampoule may be taken out of the housing and used as a common ampoule filled with a liquid solution.

FIG. 2 shows a modification of FIG. 1 in which the pointed end 17 of the first needle 16 and the second, or venting, needle 19*a* are coaxial so that the second needle 19*a,* which has a larger diameter than the first needle 16, surrounds the first end 17 of the first needle 16.

FIG. 3 shows a modification in which the first needle 16*a* is provided with a throttling 32 such that the flow of solvent from the container to the ampoule lasts for a preset time.

FIG. 4 shows another modification of FIG. 1 in which the flow of liquid from the container 3*a* to the ampoule 1 is damped. Such damping is obtained by transmitting the pressurizing force of the spring 11 to the piston 12 forming the bottom of the liquid-containing chamber 4 through a hydraulic transmission containing a viscous fluid 30, the flow of which of which is throttled. FIG. 3 shows a moveable piston 25, for containing the viscous fluid 30, on which the spring 11 acts. The flow of the viscous fluid in the chamber 30 toward the piston 12 may be throttled in any suitable manner. FIG. 3 indicates a throttling schematically using a disk 26 with a restrictive passage 27.

FIG. 5 shows an alternative embodiment in which the container 3*b* and ampoule 1 are positioned coaxially in the housing 5*a* with their closing membranes facing each other and the first needle 16*a* lying between these closing membranes with its pointed first 17 and second 18 ends facing the respective membranes. In this embodiment, mixing is obtained by pressing the ampoule 1 and the container 3*b* towards each other. As shown, a second, or venting, needle 19*b,* with a semipermeable membrane 20*a,* is also provided to pierce the membrane of the ampoule 1 when mixing the contents. The venting needle 19*b* is the same as the venting needle 19, i.e., contains a semipermeable membrane 20*a* located outside the housing 5*a,* except that, because the ampoule 1 and container 3*b* face each other, the needle is bent to extend sideways out of the housing 5*a*.

The needle unit 13*a* forms a partition in the housing 5*a* dividing the housing 5*a* into a first and second compartment. The first needle 16*a* has its first end 17 project into the first compartment and its second end 18 project into the second compartment, the first and the second ends of the first needle facing the membranes of the ampoule 1 and container 3, respectively.

Also, in the FIG. 4 embodiment, a third needle 28 is mounted in the needle unit 13*a*. The third needle 28 has a first pointed end piercing the membrane of the container 3*b* by the actuation movement of the container 3*b* and a second opening closed by a semipermeable membrane 28*a* which will lie outside the container 3*b* when the end of the third needle 28 pierces the container's membrane. As shown, the container 3*b* and needle unit 13*a* fit sealing against the inner wall 29 of the housing 5*a*. Accordingly, when the container 3*b* and ampoule 1 are pressed towards one another, the space 31 between the container 3*b* and housing inner wall 29 is pressurized to above atmospheric pressure, forcing air from the space 31 through the needle 28 and into the container 3*b* to force out the liquid 4 through the needle 16*a*.

Practical embodiments may differ from this shown schematic embodiment in different ways without being beyond the scope of the invention. E.g. the guiding rail may be replaced by a number of pins at the corners of the needle unit which pins are guided in bores in the housing. Part of the needles and the cylinder may appear as channels or bores in a plastic block which forms the needle unit. As mentioned the pressurizing of the solvent is not necessarily provided by a spring but may be provided in other ways. Further a practical device may be provided with a dispensing mechanism which dispenses the ampoule when it is full so that the only thing a user has to do is to press the needle unit down towards the housing and he will shortly thereafter receive a filled ampoule.

We claim:

1. A kit for storage and mixing of components in which at least one is liquid, comprising:

a housing accommodating a container which contains a solvent and is closed by a pierceable membrane, means for pressurizing the solvent in the container, and a cylinder ampoule having a first end closed by a pierceable membrane, and a needle unit with needles which by an actuating movement, such actuating movement constituting a relative movement between the needle unit and the container and ampoule, pierce the respective membranes, the needles comprising a first needle with a first and second pointed ends for piercing the ampoule membrane and the container membrane, respectively, and a second needle having a pointed first end piercing the ampoule membrane by the actuation movement and a second end opening to the atmosphere through a semipermeable membrane.

2. A kit according to claim 1, wherein the means for pressurizing the solvent in the container is a spring biased piston forming the bottom of the container.

3. A kit according to claim 1, wherein the means for pressurizing the solvent in the container is designed to provide the pressurizing in response to the actuating movement.

4. A kit according to claim 3, wherein the first pointed end of the first needle and the second needle are coaxial so that the second needle which has a larger diameter than the first needle surrounds this first end of the first needle.

5. A kit according to claim 1, wherein the first needle is provided with a throttling ensuring that the flow of the solvent from the container to the ampoule lasts for a preset time.

6. A kit according to claim 1, wherein the pressurizing means are damped so that the solvent takes a preset time to flow from the container to the ampoule.

7. A kit according to claim 1, wherein the container and the ampoule are positioned coaxially in the housing with their closing membranes facing each other, that the needle unit forms a partition in the housing dividing this housing into a first and a second compartment, and that the first needle has its first end projecting into the first compartment and its second end projecting into the second compartment, the first and the second ends of the first needle facing the membranes of the ampoule and the container, respectively.

8. A kit according to claim 7, wherein a third needle is mounted in the needle unit, this, third needle having a first pointed end piercing the membrane of the container by the actuation movement and a second end opening outside the container and being closed by a semipermeable membrane, and that the container and the needle unit fit sealingly against the inner wall of the housing.

9. A kit according to claim 1, wherein a spring is provided between the needle unit and the housing so that this spring is tightened when the pointed ends of the first needle are passed through the ampoule and container closing membranes, respectively.

10. A kit according to claim 9, wherein the first needle is provided with a branch tube connecting the bore of the needle to a space behind a piston in a cylinder.

11. A kit according to claim 10, wherein a locking mechanism (24, 25) is provided which by the actuating movement of the needle unit locks the housing and the needle unit in a position with the needles penetrating the membranes, and that a connection is provided from the piston in the cylinder to the locking mechanism to unlock the housing and the needle unit when a pressure is established behind the piston.

* * * * *